US008672328B2

(12) United States Patent
Bazarko

(10) Patent No.: US 8,672,328 B2
(45) Date of Patent: Mar. 18, 2014

(54) WORD-FORMING GAME AND METHOD

(75) Inventor: Jeffrey Warren Bazarko, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 13/458,170

(22) Filed: Apr. 27, 2012

(65) Prior Publication Data

US 2012/0274027 A1 Nov. 1, 2012

Related U.S. Application Data

(60) Provisional application No. 61/480,783, filed on Apr. 29, 2011.

(51) Int. Cl.
*A63F 1/02* (2006.01)
*A63F 9/20* (2006.01)

(52) U.S. Cl.
USPC ..... 273/294; 273/293; 273/272; 273/299; 273/290; 273/288; 434/171; 434/172; D21/391; D21/390; D21/386

(58) Field of Classification Search
USPC ..... 273/294, 293, 272, 299, 290, 288; 434/171, 172; D21/386, 390, 391
See application file for complete search history.

(56) References Cited

U.S. PATENT DOCUMENTS

| | | | | | |
|---|---|---|---|---|---|
| 1,085,405 | A | * | 1/1914 | Dadd | 434/345 |
| 1,532,875 | A | | 4/1925 | Brown | |
| 3,869,125 | A | * | 3/1975 | Odier | 273/294 |
| 4,283,058 | A | | 8/1981 | de Cadier | |
| 4,333,656 | A | | 6/1982 | Sommer | |
| 4,550,915 | A | | 11/1985 | Meyer | |
| 4,934,711 | A | | 6/1990 | Runstein | |
| 4,957,443 | A | | 9/1990 | Schwartz | |
| 5,417,432 | A | | 5/1995 | Dwyer | |
| 5,639,091 | A | | 6/1997 | Morales | |
| D392,691 | S | * | 3/1998 | Winder | D21/391 |
| 5,863,043 | A | | 1/1999 | Bitner | |

(Continued)

FOREIGN PATENT DOCUMENTS

| | | | |
|---|---|---|---|
| CN | 201175570 | Y | 1/2009 |
| DE | 2922854 | A1 | 12/1980 |
| GB | 1267799 | A | 3/1972 |
| WO | 2008020204 | A1 | 2/2008 |

OTHER PUBLICATIONS

International Search Report for Application No. 12165555.9; Dated: Jul. 23, 2012.

*Primary Examiner* — Benjamin Layno
(74) *Attorney, Agent, or Firm* — Cantor Colburn LLP

(57) ABSTRACT

A method of playing a word forming game comprises distributing a predetermined number of tiles to a set of players so as to form a hand of play associated with each player. Each tile has a character value associated with the tile, and at least one tile has a special feature value. The players form words on a playing surface, and the words comprise one or more tiles from a player's hand of play and one or more tiles already on the playing surface. Exemplary special feature values instruct players to skip a turn, to reverse the order of play, or to redistribute tiles. Each tile has a nesting portion and a nested portion. The nesting portion is characterized a concavity into which another playing tile may be nested and the nested portion is characterized by a convex edge.

20 Claims, 3 Drawing Sheets

(56) References Cited

U.S. PATENT DOCUMENTS

| | | | | |
|---|---|---|---|---|
| 6,234,486 | B1 | 5/2001 | Wallice | |
| 6,447,300 | B1 | 9/2002 | Greenberg | |
| 6,557,854 | B1 | 5/2003 | Jaspers | |
| 6,575,468 | B1 | 6/2003 | Hall | |
| D476,700 | S * | 7/2003 | Manville | D21/484 |
| 6,588,756 | B1 | 7/2003 | Hughes | |
| 6,863,275 | B2 | 3/2005 | Chiu et al. | |
| 6,910,893 | B2 | 6/2005 | Dillhoff | |
| 7,216,868 | B2 | 5/2007 | Groz et al. | |
| 7,344,137 | B2 | 3/2008 | Loke | |
| D582,991 | S * | 12/2008 | McCowan | D21/391 |
| D583,877 | S * | 12/2008 | Denoual | D21/391 |
| 7,604,237 | B2 | 10/2009 | Czekanski | |
| 7,857,315 | B2 | 12/2010 | Hoyt | |
| 2003/0230848 | A1 | 12/2003 | Mellerowicz | |
| 2007/0222155 | A1 * | 9/2007 | Denoual | 273/293 |
| 2008/0042356 | A1 | 2/2008 | Ahmad et al. | |
| 2010/0207329 | A1 | 8/2010 | Bigelow | |
| 2010/0207948 | A1 | 8/2010 | D'Ambrosio et al. | |
| 2012/0256376 | A1 * | 10/2012 | Kasai | 273/288 |

* cited by examiner

WORD-FORMING GAME AND METHOD

CROSS REFERENCE TO RELATED APPLICATIONS

This application claims the benefit of U.S. Provisional Patent Application Ser. No. 61/480,783, filed Apr. 29, 2011, the contents of which are incorporated herein by reference thereto.

BACKGROUND

Board games are played for entertainment and education. One example of such a game is the word game commonly known as the SCRABBLE board game.

It is desirable to provide new board games, variants of existing board games and methods of playing such games to provide excitement to users of these games.

SUMMARY OF THE INVENTION

In one embodiment a method of playing a word forming game is provided, the method including the steps of: distributing a predetermined number of tiles to a set of players so as to form a hand of play associated with each player. Each tile has a character value associated with the tile, and at least one tile has a special feature value. The players form words on a playing surface, and the words comprise one or more tiles from a player's hand of play and one or more tiles already on the playing surface. Exemplary special feature values instruct players to skip a turn, to reverse the order of play, to redistribute tiles. In an exemplary embodiment, each tile has a nesting portion and a nested portion, wherein the nesting portion is characterized by a concavity into which another playing tile may be nested, and wherein the nested portion is characterized by a convex edge.

In another exemplary embodiment, the nested portion defines a circle having a radius that is substantially equal to a radius of a circle defined by the nesting portion, and an arc traversed along the nesting portion is substantially shorter than an arc traversed along the nested portion, whereby the direction of the tiles may be changed.

In yet another exemplary embodiment, a game is provided. The game having: a plurality of tiles, each tile having a nesting portion and a nested portion, wherein the nesting portion is characterized by a concavity into which another playing tile may be nested, and wherein the nested portion is characterized by a convex edge; at least one of the tiles displaying a character value; and at least one of the tiles displaying a special feature value.

In still yet another embodiment, a word game is provided. The word game having: a plurality of tiles, each tile having a nesting portion and a nested portion, wherein the nesting portion is characterized by a concavity into which another playing tile may be nested, and wherein the nested portion is characterized by a convex edge; and wherein the nested portion of each of the plurality of tiles is a portion of a curved peripheral edge of the tile, wherein the portion of the curved peripheral edge is configured to match the convex edge of another tile.

BRIEF DESCRIPTION OF THE DRAWINGS

Other features, advantages and details appear, by way of example only, in the following description of embodiments, the description referring to the drawings in which.

DETAILED DESCRIPTION

Figure 1:
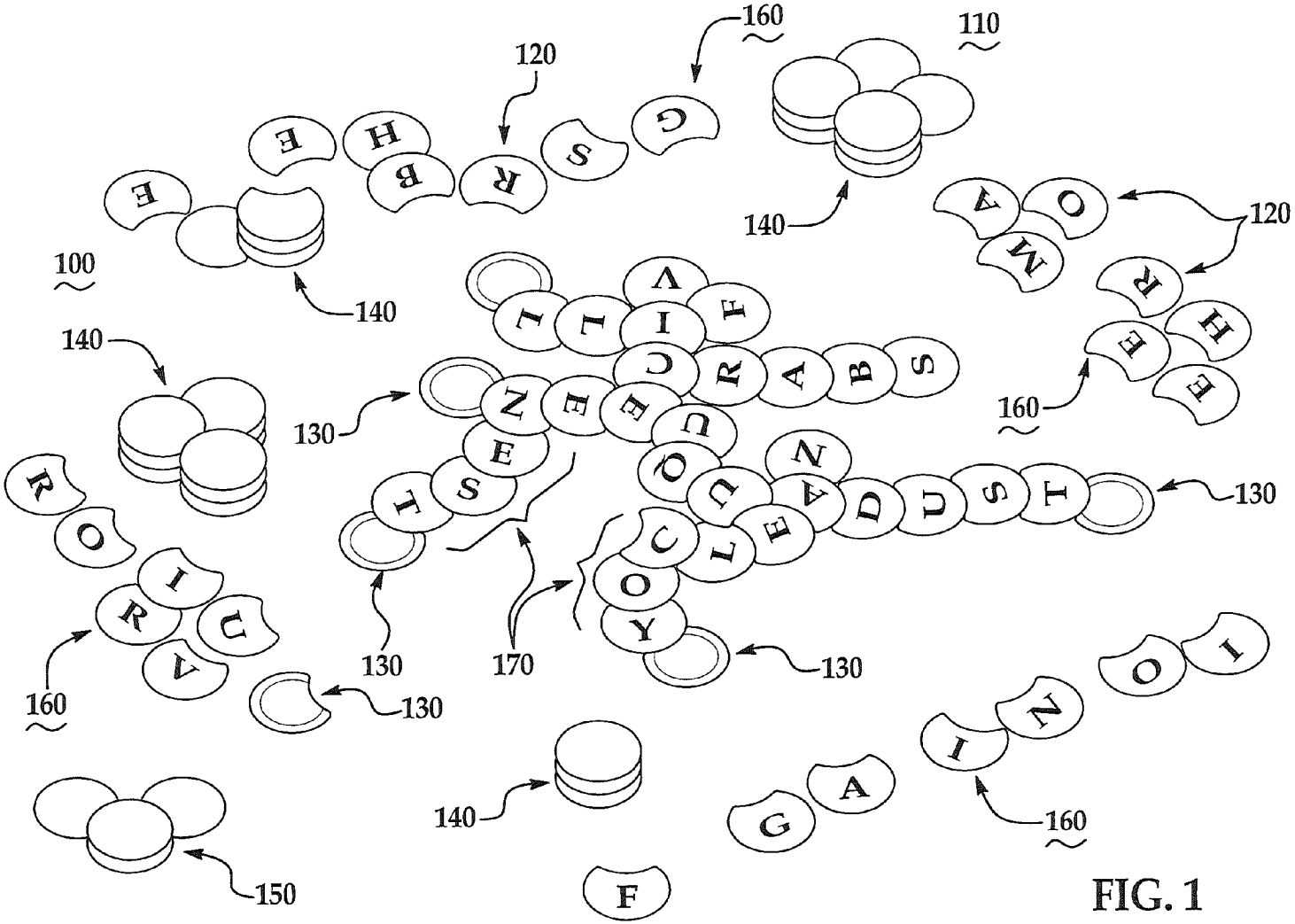
FIG. 1 illustrates an exemplary embodiment of the present invention.

In an exemplary embodiment, the present invention provides systems and methods for enhancing the playing experience for word games. FIG. 1 shows an exemplary game 100 in the process of being played. The game 100 comprises a plurality of playing tiles 110, which comprise a predetermined number of letter tiles 120, and a smaller predetermined number of special tiles 130.

As shown in FIG. 1 and as the game is played, the playing tiles 110 are spread out on a playing surface. It should be appreciated that the playing surface may be any structure such as a table or the floor or another surface, to which playing tiles may be placed or alternatively adhered wherein the playing tiles 110 may be displayed or otherwise supported. For example, in one embodiment, the playing surface is a magnetic wall surface, and playing tiles 110 are magnetically reactive so that they may be adhered to the magnetic wall surface. In another embodiment, the playing surface is includes hook and loop fasteners, and playing tiles 110 have a cooperating hook and loop backing so that they may be adhered to the hook and loop surface. In still other embodiments, the playing tiles and/or the playing surface have an adhesive. Otherwise, the playing surface may be any horizontally oriented surface.

In still another embodiment, the playing surface is a screen such as a CRT display, an LCD display, or any other suitable display means known in the art for displaying information. In this embodiment, playing tiles are represented by a visual image displayed on the screen so as to provide a similar game experience. A processor receives instructions from players through a suitable user interface, or set of user interfaces, which facilitate receipt of instructions from players and implement those instructions in accordance with the rules of the game. The displayed image, as controlled by the processor, provides a visual representation of the game as it is played in accordance with the instructions from the players and the rules administered by the processor.

In one embodiment, the playing tiles 110 are divided evenly among a plurality of players (e.g., two to four players of course, other numbers are contemplated) so as to form a reserve pile 140 for each player. In situations where smaller numbers of players (e.g., two players) are competing, each reserve pile 140 may comprise a larger number of playing tiles 110. In situations where three players are competing, each reserve pile 140 may comprise a slightly smaller number of playing tiles 110. In situations where four players are competing, each reserve pile 140 may comprise an even smaller number of playing tiles 110. Accordingly, regardless how many players are competing, each reserve pile 140 comprises a number of playing tiles such that playing tiles 110 are divided evenly among the players, and at least one playing tile remains in a surplus pile 150. As the reserve piles 140 are being formed, the playing tiles 110 are maintained in a face-down orientation as described more fully below.

Once the reserve piles 140 have been formed, a predetermined number of playing tiles 110 from each reserve pile 140 are flipped so as to occupy a face-up orientation. In one non-limiting embodiment, the number of tiles flipped up is seven. Other numbers greater or less than seven are contemplated to be within the scope of the present invention. Each set of face-up tiles from a particular reserve pile 140 forms an associated hand of play 160. In an exemplary embodiment, an object of the game is to be the first player to get rid of or play all their tiles to win the game. In some embodiments, after the playing tiles have been distributed as described above, one of the playing tiles from the surplus pile 150 is flipped right side up in the center of the table so as to reveal a display side of that playing tile. This letter becomes the starting letter, and the remaining tiles from the surplus pile are out of the game. In other embodiments, after the playing tiles have been distributed, play begins with a first player playing tiles only from their associated hand of play 160.

On their turn a player will use any number of the tiles in their hand to form a word in the center of the table or surface using at least one tile that already exists in the center puzzle. In one embodiment, if they are the first player, there will not be any tiles in the center so they must spell a word entirely from their hand. Alternatively, a starting tile may be employed. In accordance with one non-limiting exemplary embodiment, the tile placement shall be subject to the following rules: tiles must nest together; tiles that are already played in the center cannot be moved to make room for new tiles; special tiles are the last tile to be played but can be placed on any of the tiles that the player has played this turn. Passing: if a player decides that they cannot play a word, they may choose to pass. In one embodiment, they may then place as many tiles from their hand face down on the bottom of their reserve and draw an equal amount of tiles as a replacement. Instead of passing, a player may choose to only play an action or special tile. In that case, the player may place the action tile adjacent to any tile in the center.

The end of the game is determined when one player has used all of their tiles or if every player passes in succession then the player with the fewest tiles after each player passes wins.

As shown in FIG. 1, players have assembled playing tiles on the playing surface so as to form words 170 such as "COY" and "NEST". In the word "COY" 170, the letter tile that bears the "C" nests into the letter tile bearing the letter "O", and the letter tile that bears the "O" nests into the letter tile bearing the letter "Y". The letter tile that bears the "Y" nests into a special tile 130, which bears a symbol indicative of a special feature of the tile. In addition, as the words "COY" and "NEST" are spelled out, changes in direction are formed such that words are not constrained to follow a straight line or an orthogonal grid pattern. Thus, numerous play options are provided.

Figure 2:
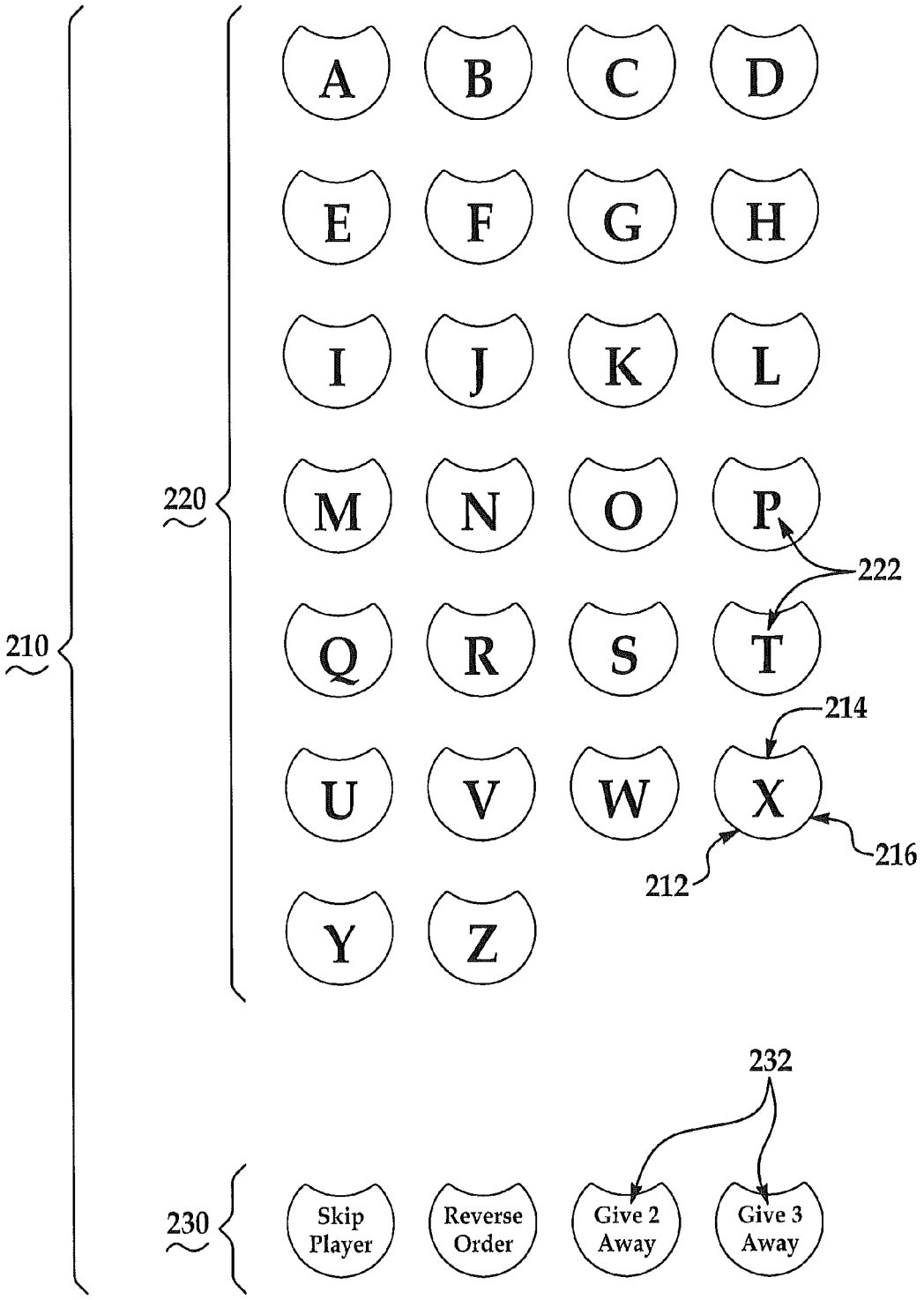
FIG. 2 shows an exemplary set of tiles in accordance with an embodiment of the invention.

FIG. 2 shows a set of playing tiles 210 comprising standard character tiles 220 and special character tiles 230. In this embodiment, each playing tile 210 is relatively thin (e.g., approximately one-sixteenth to one-quarter of an inch thick) and is generally circular in shape with a diameter equal to approximately one to two inches, preferably one and one-quarter of an inch. Other configurations are contemplated to be within the scope of exemplary embodiments of the present invention. Each playing tile 210 is generally planar and has a perimeter edge 212 that is generally continuous within two distinct regions—a nesting portion 214 and a nested portion 216. In an exemplary embodiment, the perimeter edge 212 defines the generally circular shape of each playing tile 210. At the nesting portion 214, the perimeter edge 212 defines a concavity into which another playing tile 210 may be nested. The perimeter edge 212 also defines the nested portion 216 characterized by a portion of the playing tile 210 having a convex edge. Accordingly the perimeter edge is continuous along both the nesting portion and the nested portion of a playing tile.

In an exemplary embodiment, the nested portion includes an arc of a circle. The nesting portion also includes an arc of a circle, where the arc of the nesting portion is shorter than the arc of the nested portion. However, the arc of the nested portion may have a radius that is substantially equal to the radius of the arc of the nesting portion. Accordingly each nested portion 216 is configured to mate with a nesting portion 214 of another playing tile. For example, a portion of the arc of the nested portion of one playing tile may fit within the arc of the nesting portion of another playing tile. It should be noted that the convex portion of each playing tile comprises at least half of the circumference of each playing tile. Put another way, an arc traversed by a perimeter edge 212 along the nesting portion 214 of each playing tile 210 is substantially shorter than an arc traversed by a perimeter edge 212 along the nested portion 216 of each playing tile 210. Therefore, as playing tiles are nested together, the direction of the tiles may be changed as differing arc portions of the nested portion of one playing tile nests with the arc of the nesting portion of another playing tile. A wide array of orientations are possible so that a word may be conformed to the space available at the time the word is played.

Standard character tiles 220 each have a display side and a blank side. Standard character tiles 220 each display, on their display sides, a character value 222 associated with the tile 220. Blank sides may display an emblem, logo, design or other information but do not reveal the information displayed on the display side (i.e., the character value 222 associated with the tile). Character values may be any formative of a complete word or phrase such that each character value may be used to form a complete word or phrase—either alone or in combination with one or more other formatives from one or more other tiles. Exemplary character values include alphanumeric characters (e.g., a, b, c, d, etc.), syllables (e.g., un, bi, tac, pur, mon), Japanese characters such as hiragana, katakana, or kanji, and characters from other languages. In an exemplary embodiment, tiles may also display a point value. Exemplary point values include any numerical point value (e.g., + or −0 to infinity, 1, 2, 3, 4, 5).

Special character tiles 230 also have a display side and a blank side. Special character tiles 230 each display, on their display sides, a special feature value 232 associated with the special character tile 230. Blank sides may display a design or other information but do not reveal the information displayed on display side (i.e., special feature value 232 associated with the tile). Exemplary special feature values include "skip player", "reverse order of play", "give two tiles away", and "give three tiles away". The above-described special feature values can be used to affect the order of players' turns and the content of the players' allocation of playing tiles. Specific special feature values may be represented by words as described above or may be conveyed using symbols. For example, a pair of opposing arrows may be used to indicate a reversal of the order of play. Similarly, a circle with a diagonal line through it may be used to indicate that the next player will skip a turn. An arrow with a graphic depicting two or three tiles could be used to indicate that a player may or must give away a corresponding number of tiles from his or her hand of play.

In accordance with an exemplary embodiment of the invention, each special feature value invokes a special feature of play. For example, a special feature value of "skip player", displayed either in words or corresponding symbols, invokes a special feature of play characterized by the skipping of the next player's turn. A special feature value of "reverse order" invokes a special feature of play characterized by reversal of the direction of play (i.e., reversing the order of players' turns). A special feature value of "give two away" invokes a special feature of play characterized by a player's distributing a total of two tiles to one or two other players chosen by the distributing player. A special feature value of "give three tiles away" invokes a special feature of play characterized by a player's distributing a total of three tiles to one, two, or three other players as chosen by the distributing player. Thus, the special character tiles add an added dimension or aspect to the game.

In some embodiments, in addition to the standard character tiles 220 and the special character tiles 230, the set of playing tiles 210 further includes one or more blank character tiles. A blank character tile may stand in for any standard character tiles 220 in a word being played. A blank character tile may have a similar make and appearance to a standard character tile, but instead may have no features (i.e. it is "blank") on its display side.

Figure 3:
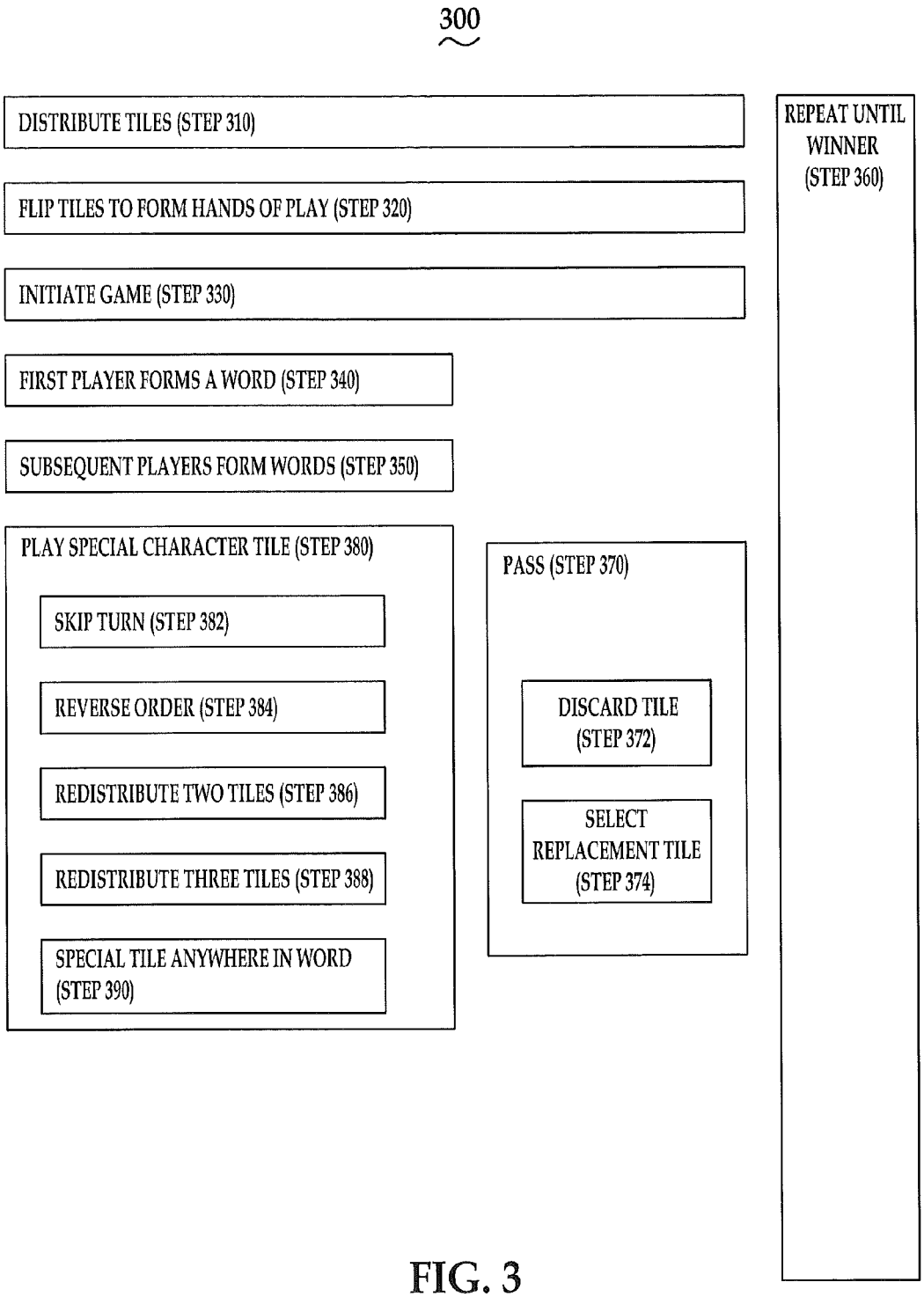
FIG. 3 shows an exemplary method for playing a game in accordance with the invention.

FIG. 3 shows an exemplary method 300 for playing a word game in accordance with an exemplary embodiment of the invention. As shown in FIG. 3, a predetermined number of tiles are distributed to each of the players (step 310). Those distributed tiles form the players' reserve piles. The tiles in each player's reserve pile are maintained with their display sides hidden from view (e.g., face down) and their blank sides showing (e.g., face up). Each player flips over a predetermined number (e.g., seven) of the tiles in his/her reserve pile (step 320), exposing the display sides of the tiles and forming each player's hand of play. To initiate the game, one of the un-distributed tiles is flipped right side up in the center of the playing surface so as to reveal its display side (step 330). The remaining undistributed tiles are not used and are considered "out of the game."

Based on a predetermined method (e.g., coin toss, dice roll, blind tile selection, players' ages such as wherein the youngest player goes first), a first player is selected and uses any number of the tiles in his hand to form a word that includes the single tile that was placed in the center of the playing surface and additional tiles from the player's hand of play (step 340). In other embodiments, after the playing tiles have been distributed, play begins with a first player playing tiles only from their hand of play.

On their turn a player will use any number of the tiles in their hand of play to form a word in the center of the table using at least one tile that already exists in the center puzzle. In accordance with this embodiment, tiles being played so as to form a word or phrase must be placed so as to nest together, and may not be placed where their nested combination with an adjacent tile fails to form a word or phrase, and tiles may touch other tiles only where touching tiles form word being played. Moreover, tiles that have already been played cannot be moved to accommodate placement of new tiles and/or formation of new words or phrases. Nonetheless, because playing tiles nest with one another along continuous edges of the nesting and nested portions of the playing tiles, and because an arc traversed along the nesting portion is substantially shorter than an arc traversed along the nested portion, the direction of the tiles may be changed.

After the first player completes his/her turn, each subsequent player uses any number of the tiles in his/her hand to form a word that includes any previously one or more tiles on the playing surface (step 350). Players take turns according to a predetermined order, continuing to add tiles and forming words until a winner is declared (step 360). In one embodiment, the winner is the first player to play all of his or her tiles. Thus, as soon as one player has used all of their tiles, that player is declared the winner. Alternatively, the winner is the first player to play all of his or her tiles and none of the other players can play all of their tiles before play returns to the first player. Alternatively, if every player passes in succession with no words being formed/played, then the player with the fewest remaining tiles in that player's hand of play is declared the winner. Alternatively, the player having earned the most points from tiles that person has played may be declared the winner. In another embodiment, the game is played until a player acquires a predetermined number of points, such as 500 points.

If a player decides that they cannot play a word, that player may choose to pass (step 370). Upon passing, the player places one playing tile from their hand on the bottom of their reserve pile with the display side hidden (step 372). The passing player then draws the top tile as a replacement and places that drawn tile in the player's hand of play with its display side showing (step 374).

In an exemplary embodiment, a player may use a special character tile as the last tile of a word being played (step 380). In accordance with this embodiment, a player may not form a word using a special character tile except where the special character tile occurs at the end of the word being formed/played. If a player plays a special character tile with a special feature value of "skip", then the next player's turn is skipped (step 382). If a player plays a special character tile with a special feature value of "reverse", then the direction of play is reversed (i.e., the order of players' turns is reversed). If a player plays a special character tile with a special feature value of "give two", then that player may distribute a total of two tiles to one or two other players chosen by the distributing player. If a player plays a special character tile with a special feature value of "give three", then that player may distribute a total of three tiles to one, two, or three other players as chosen by the distributing player.

In another exemplary embodiment, a player may use a special character tile in any position within a word being played (step 390). In accordance with this embodiment, a player is allowed to form a word using a special character tile within the word being formed/played so long as the player follows the instructions associated with the special feature of the tile. In alternate embodiments, a player may play a special character tile adjacent any standard character tile played during their turn.

The present disclosure provides games and method for playing games such as word games. Further, the present disclosure provides an interesting set of variations to enhance the playing experience by adding new and interesting twists to compensate for disparities between playing abilities of competitors or to accommodate players with increased levels of experience. The disclosed games and methods may be implemented using conventional plastic or pressed board playing surfaces with plastic, wooden, or cardboard tiles or may be implemented as a virtual game presented via a display system. The word game is easy to learn and interesting for the players. The word game is versatile and accordingly individuals from all age groups may be interested in playing the word game.

The foregoing descriptions of specific exemplary embodiments are presented for purposes of illustration and description. They are not intended to be exhaustive or to limit the present disclosure to the precise forms disclosed, and obviously many modifications and variations are possible in light of the above teaching. It will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A game comprising:

a plurality of tiles, each tile having a perimeter edge that is continuous with two distinct regions a nesting portion and a nested portion, wherein the nesting portion is characterized by a concavity into which a nested portion of another playing tile may be nested, and wherein the nested portion is characterized by a convex edge, wherein the perimeter edge is continuous along both the nesting portion and the nested portion and the nested portion is defined by an arc that extends from one end of the nesting portion to an opposite end of the nesting portion, wherein the portion of the nested portion of each of the plurality of tiles is a portion of a curved peripheral edge of the tile, wherein the portion of the curved peripheral edge is configured to match the convex edge of the nesting portion of another one of the plurality of tiles and wherein the nested portion of one of the plurality of tiles may be rotated with respect to the nesting portion of another one of the plurality of tiles after and while the nested portion is inserted into the nesting portion;

at least one of the tiles displaying a character value; and at least one of the tiles displaying a special feature value.

2. The game of claim 1, wherein the special feature value instructs a player to skip a turn.

3. The game of claim 1, wherein the special feature value instructs a player to reverse the order of play.

4. The game of claim 1, wherein the special feature value instructs a player to give two tiles away.

5. The game of claim 1, wherein the special feature value instructs a player to give three tiles away.

6. The game of claim 1, wherein the arc of the nested portion has a radius that is substantially equal to a radius of an arc of a circle included in the nesting portion.

7. The game of claim 1, wherein the arc traversed along the nesting portion is substantially shorter than the arc traversed along the nested portion, and when the nested portion of one tile is inserted into a nesting portion of another tile, the tiles may be rotated with respect to each other such that the characters of each one of the tiles nested into each other can be arranged in a non-linear fashion.

8. The game of claim 7, wherein the rotation of one tile with respect to another comprises an angle substantially less than 90 degrees.

9. The game of claim 7, wherein the rotation of one tile with respect to another comprises an angle substantially greater than 90 degrees.

10. A word game, comprising:

a plurality of tiles, each tile having a perimeter edge that is continuous and defined only by two distinct regions a nesting portion and a nested portion, wherein the nesting portion is characterized by a concavity into which a portion of a nested portion of another one of the plurality of playing tiles may be nested, and wherein the nested portion is characterized by a convex edge that extends from one end of the nesting portion to an opposite end of the nesting portion; and wherein the portion of the nested portion of each of the plurality of tiles is a portion of a curved peripheral edge of the tile, wherein the portion of the curved peripheral edge is configured to match the convex edge of the nesting portion of another one of the plurality of tiles, wherein each of the plurality of tiles is capable of being rotatably received within another one of the plurality of tiles by inserting the portion of the nested portion into the nesting portion of the another one of the plurality of tiles.

11. The word game as in claim 10, wherein at least one of the plurality of tiles displays a character value; and at least one of the plurality of tiles displays a special feature value.

12. The word as in claim 11, wherein the special feature value instructs a player to skip a turn.

13. The word game as in claim 11, wherein the special feature value instructs a player to reverse the order of play.

14. The word game as in claim 11, wherein the special feature value instructs a player to give two tiles away.

15. The word game as in claim 11, wherein the special feature value instructs a player to give three tiles away.

16. The word game as in claim 10, wherein the convex edge of the nested portion has a radius that is substantially equal to a radius of an arc of a circle included in the nesting portion.

17. The word game as in claim 10, wherein the nesting portion is substantially shorter than the convex edge, and when the nested portion of one tile is inserted into a nesting portion of another tile, the tiles may be rotated with respect to each other such that the characters of each one of the tiles nested into each other can be arranged in a non-linear fashion.

18. The word game as in claim 17, wherein the rotation of one tile with respect to another comprises an angle substantially less than 90 degrees.

19. The game of claim 17, wherein the rotation of one tile with respect to another comprises an angle substantially greater than 90 degrees.

20. The word game as in claim 10, wherein the arc traversed along the nesting portion is substantially shorter than the arc traversed along the nested portion.

* * * * *

UNITED STATES PATENT AND TRADEMARK OFFICE

CERTIFICATE OF CORRECTION

PATENT NO. : 8,672,328 B2
APPLICATION NO. : 13/458170
DATED : March 18, 2014
INVENTOR(S) : Jeffrey Warren Bazarko It is certified that error appears in the above-identified patent and that said Letters Patent is hereby corrected as shown below:

In the Specification

Col. 1, line 2 Cross Reference to Related Application:
The application has been amended as follows:

"U.S. Provisional Patent Application Serial No. 61/480,783" has been changed to -- U.S. Provisional Patent Application Serial No. 61/480,837 --.

Signed and Sealed this
Third Day of February, 2015

Michelle K. Lee

Michelle K. Lee
*Deputy Director of the United States Patent and Trademark Office*